United States Patent [19]

Iwata et al.

[11] 4,385,486

[45] May 31, 1983

[54] APPARATUS FOR MANUFACTURING OPEN CORD

[75] Inventors: Shouji Iwata, Suita; Masaru Tanaka, Miki; Fumio Yamashita; Hideharu Kurobe, both of Ono; Takuo Itani, Kobe, all of Japan

[73] Assignee: Tokusen Kogyo Kabushiki Kaisha, Ono, Japan

[21] Appl. No.: 199,216

[22] Filed: Oct. 21, 1980

[30] Foreign Application Priority Data

| | | | |
|---|---|---|---|
| Oct. 22, 1979 | [JP] | Japan | 54-136571 |
| Dec. 21, 1979 | [JP] | Japan | 54-167018 |
| Jun. 14, 1980 | [JP] | Japan | 55-83603 |
| Jun. 14, 1980 | [JP] | Japan | 55-83604 |
| Jun. 14, 1980 | [JP] | Japan | 55-83605 |
| Jul. 11, 1980 | [JP] | Japan | 55-95270 |
| Jul. 11, 1980 | [JP] | Japan | 55-95271 |

[51] Int. Cl.[3] ..... D07B 3/00; D07B 7/00

[52] U.S. Cl. ..... 57/58.52; 57/9; 57/212; 57/311; 57/58.59; 57/902

[58] Field of Search ..... 57/1 UN, 2.3, 2.5, 6, 57/9, 33, 58.52, 58.83, 66.5, 67, 138, 311, 313, 902, 58.59, 212

[56] References Cited

U.S. PATENT DOCUMENTS

| | | | |
|---|---|---|---|
| 2,010,184 | 8/1935 | Furth | 57/138 |
| 2,143,417 | 1/1939 | Johannessen et al. | 57/1 UN |
| 2,921,429 | 1/1960 | Haugwitz | 57/58.52 |
| 3,945,182 | 3/1976 | Dover et al. | 57/58.52 |
| 4,064,685 | 12/1977 | Polke | 57/311 |
| 4,100,721 | 7/1978 | Seiichi et al. | 57/58.52 X |
| 4,182,106 | 1/1980 | Henry | 57/311 X |
| 4,195,469 | 4/1980 | Tarantola | 57/311 |
| 4,258,543 | 3/1981 | Conevari et al. | 57/902 X |

*Primary Examiner*—Donald Watkins

*Attorney, Agent, or Firm*—Wenderoth, Lind & Ponack

[57] ABSTRACT

An apparatus is provided for manufacturing an open cord to be used as a reinforcement for automobile tires, conveyor belts, etc. and having uniform spaces between steel wires and stable construction.

9 Claims, 36 Drawing Figures

Fig. 5 (a)
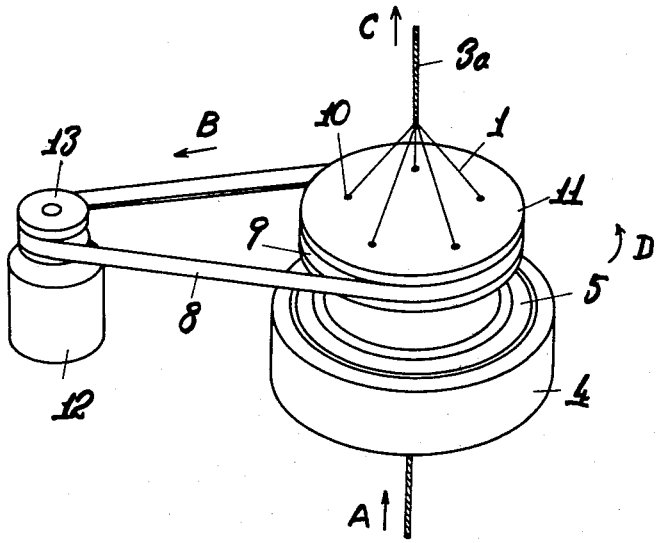
Fig. 4 (a)
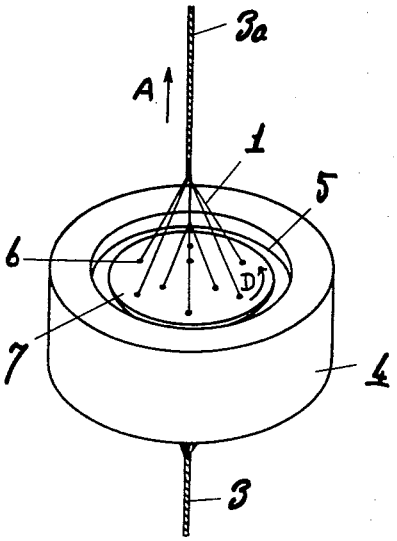
Fig 5 (b)
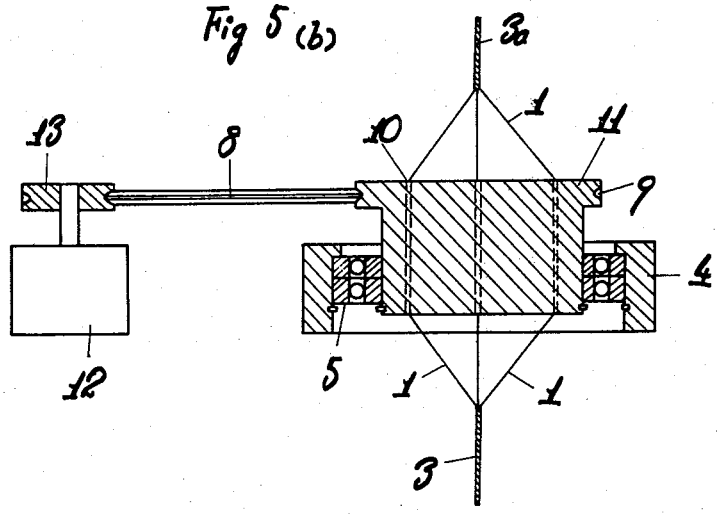
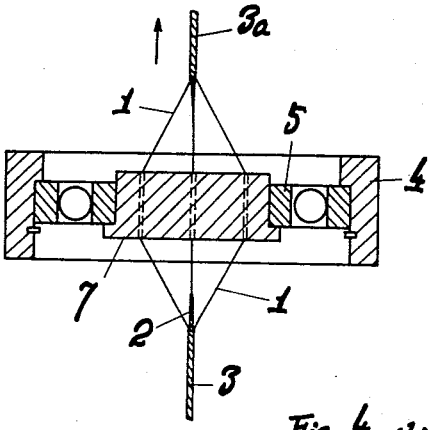
Fig. 4 (b)

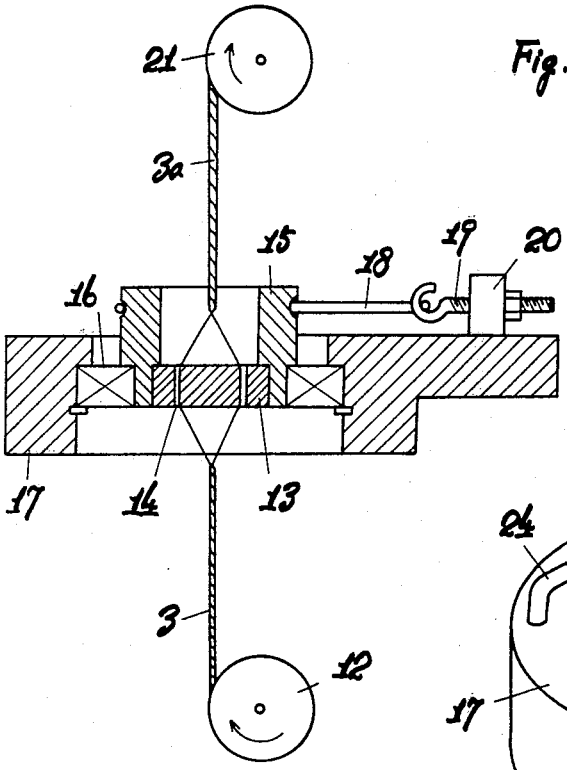
Fig. 6
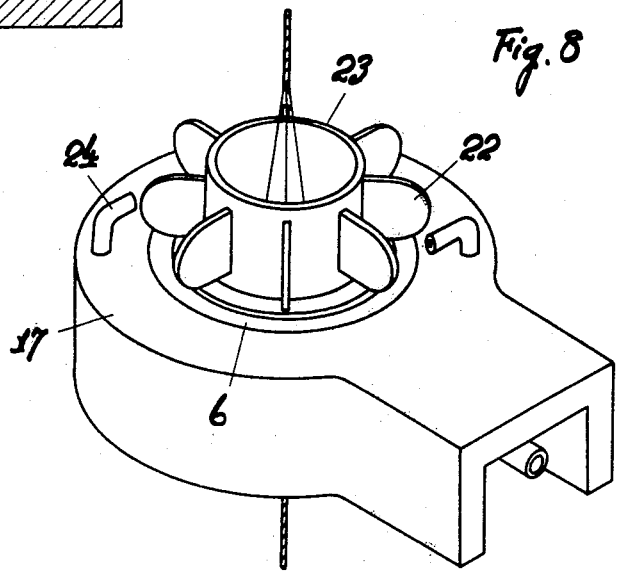
Fig. 8
Fig. 7
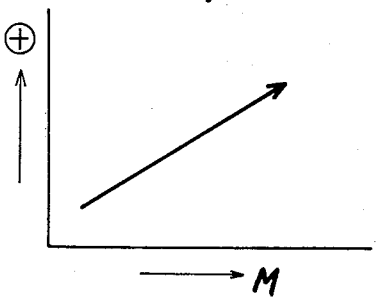
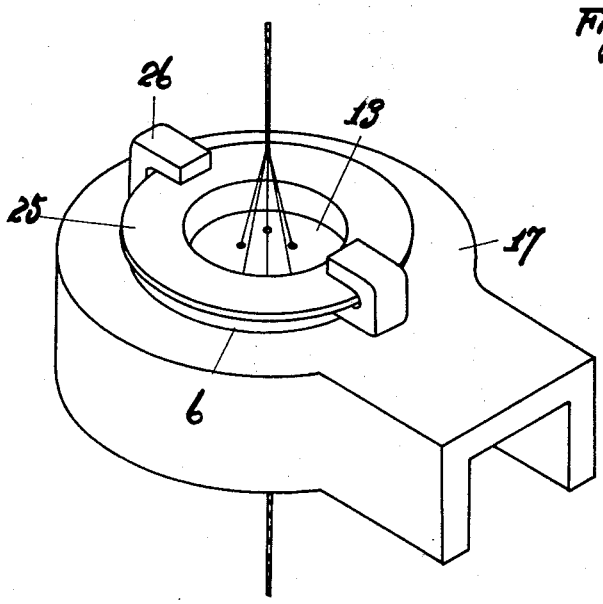
Fig. 9

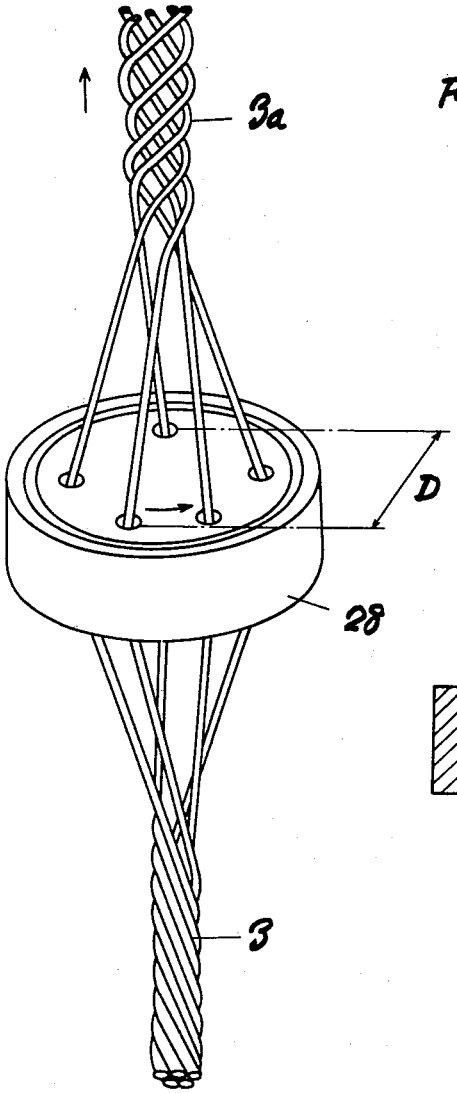
Fig. 10 (b)
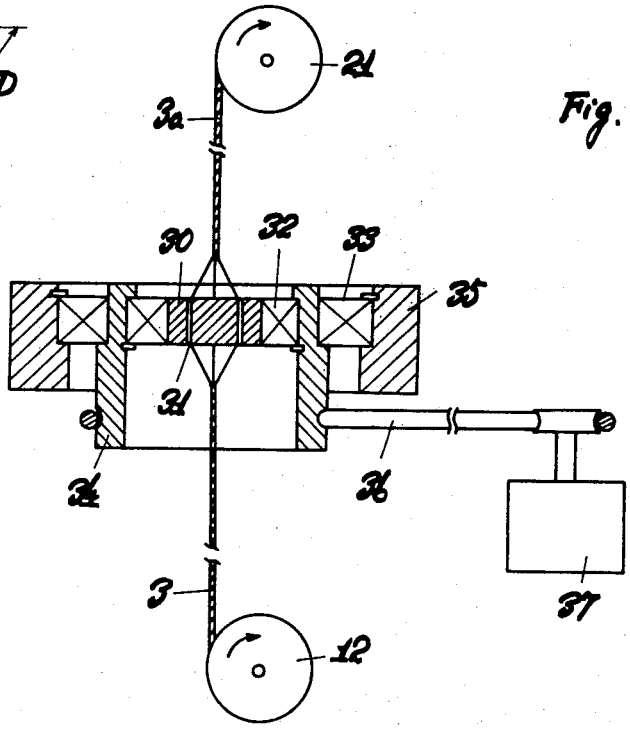
Fig. 11
Fig. 12
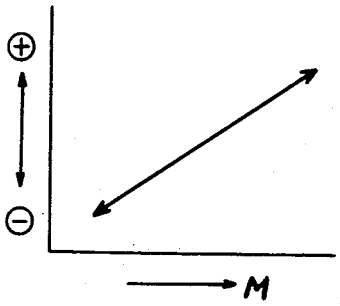
Fig. 13
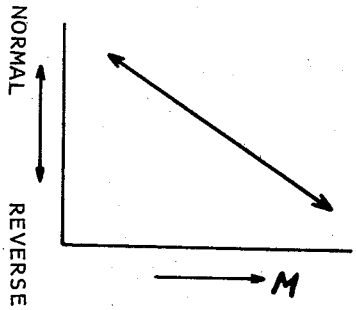

APPARATUS FOR MANUFACTURING OPEN CORD

BACKGROUND OF THE INVENTION

This invention relates to an apparatus for making an open cord, comprising a plurality of steel wires with spaces therebetween, which is used as a reinforcement for rubber goods such as automobile tires, conveyor belts, high pressure rubber hoses, etc.

A conventional steel cord 3 to be used as reinforcement of rubber goods is made by intertwisting a plurality of steel wires 1 as shown in FIG. 1 (*a*) and FIG. 1 (*b*). In FIG. 1 (*b*) numeral 2 denotes a core strand. However, since such conventional steel cord 3 comprises several steel wires 1 which are in tight contact with each other, when the cord is covered with a rubber compound, such rubber compound will not penetrate into the core and as a result, adhesion between each steel wire 1 of the steel cord 3 and the rubber compound is imperfect. Thus, the conventional steel core cannot perform its duties fully as a reinforcement. For example, when the conventional steel cord is used as a reinforcement for automobile tires, such trouble as the rubber compound separating from the steel cord or the so-called "separation phenomenon" is caused during operation, which results in impairing the function of the tires considerably. Moreover, since the rubber does not penetrate into the core of the steel cord, a space is present at the core and humidity in the rubber, humidity in the atmosphere, etc. penetrate into such space, with the result that the steel wires gather rust easily and such rust spreads rapidly all over the steel cord, causing a sharp reduction of steel cord the strength of the, breakage of the steel cord and above mentioned "separation phenomenon".

In order to eliminate the above-mentioned disadvantages, it has been proposed to put to practical use a such steel cord having loosely intertwisted steel wires, or the so-called open cord, which is made by intertwisting several steel wires 1 with spaces left therebetween as shown in FIG. 3 (*a*) and FIG. 3 (*b*). However, no practical apparatus for manufacturning such above-mentioned steel cord of such soft twist, no has yet been developed. The only method under consideration is to use a wire stranding machine of tubular type, whereby each steel wire is curled excessively by a conventional cone pin. According to this method, however, the steel cord 3*a* with loosely twisted wires easily becomes unstable during twist construction, the steel wires 1 become one-sided as shown in FIGS. 2 (*a*), (*b*) and (*c*), and the twist becomes uneven in lengthwise direction of the cord. In an case of the open cord having such one-sided wires and unevenness of twist, even if the rubber compound penetrates into the core of the open cord, the cord is reduced in strength, has an extremely poor compression flexing fatigue characteristic, and cannot be used as a reinforcement for rubber goods.

SUMMARY OF THE INVENTION

The present invention has for its object to eliminate the above-mentioned disadvantages of the conventional steel cord and to provide an apparatus for manufacturing an open cord having steel wires intertwisted evenly and stably with spaces therebetween.

The above object is achieved by the improvement and combination of the elements constituting the apparatus according to the present invention, but preferred embodiments of the present invention will be shown in the attached drawings (FIG. 3 and succeeding figures) and the description hereinafter made.

Any change or modification of the details of the construction is intended to be included in the scope of the invention.

BRIEF DESCRIPTION OF THE DRAWINGS

FIGS. 4 (*a*) and 4 (*b*) are respectively a perspective view and a cross section of one embodiment of the present invention;

FIGS. 5 (*a*) and 5 (*b*) are respectively a perspective view and a cross section of another embodiment;

FIG. 6 is a sectional side view of the main part of another embodiment;

FIG. 7 is a diagram showing the relationship between the residual torsion and the rolling friction moment of a bearing;

FIG. 8 is a perspective view of another embodiment;

FIG. 9 is a perspective view of another embodiment;

FIG. 11 is a sectional side view of the main part of another embodiment;

FIG. 12 is a diagram showing the relation between the residual torsion and the rolling friction moment of the bearing;

FIG. 13 is a diagram showing the relationship between the R.P.M. of the pulley and the rolling friction moment of the bearing;

DETAILED DESCRIPTION OF THE INVENTION

Figure 3:
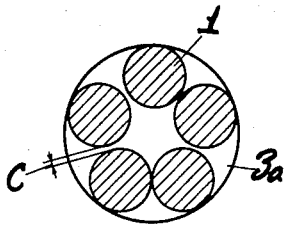
FIGS. 3 (*a*) and 3 (*b*) are cross sections of open cords made by the apparatus of the present invention.
Figure 3:
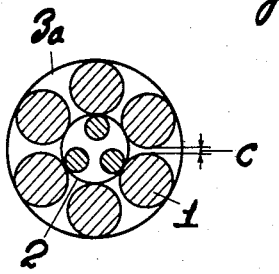
Figure 2:
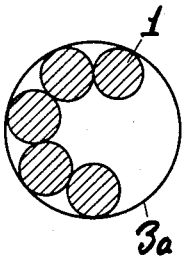
FIGS. 2 (*a*), 2 (*b*) and 2 (*c*) are cross sections of open cords made by the conventional method.
Figure 2:
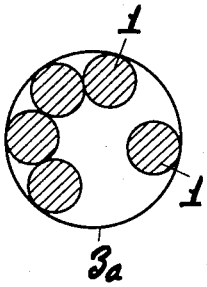
Figure 2:
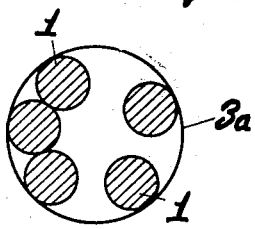

Preferred embodiments of the present invention are explained below with reference to FIG. 3 and the succeeding figures.

Embodiment No. 1

As shown by FIGS. 4 (*a*) and 4 (*b*), an outer race of a bearing 5 is secured to a frame body 4, and a lay plate 7 with holes 6 at least in a number corresponding to the number of steel wires constituting a steel cord 3 is fixed to an inner race of the bearing 5, whereby the lay plate 7 is made rotatable with respect to body 4 by the bearing 5. A top end of a steel cord 3 comprising a plurality of intertwisted steel wires 1 is untwisted and individual steel wires 1 are passed through respective of the holes 6 in the direction of arrow A, whereupon the individual steel wires 1 are twisted by the rotation (in the direction of arrow D) of the lay plate 7 and are intertwisted again into an open cord 3*a* having spaces between the steel wires 1. The frame body 4 is fitted to a machine base or the like.

Embodiment No. 2

As shown by FIGS. 5 (*a*) and 5 (*b*), a lay plate 11 for twisting has at the side edge thereof a pulley portion with a V-shaped groove 9 for a V-belt 8. Plate 11 has therethrough holes 10, through which respective steel wires 1 are passed, spaced apart at regular intervals in the circumferential direction. Plate 11 is secured to the bearing 5 fixed in the frame body 4. The pulley position and a V-shaped pulley 13 mounted on a driving axis of a motor 12 are linked with each other by the V-belt 8 for driving positively the lay plate 11 for twisting. A top end of the steel cord 3 comprising a plurality of intertwisted steel wires is untwisted, and invididual steel wires are passed through respective holes 10 of the lay plate 11 to be subjected to twisting and the steel wires are then intertwisted again into an open cord having spaces between steel wires.

The lay plate itself or holes therein as guides in Embodiments No. 1 and No. 2 are composed of abrasion-resistant material.

Figure 1:
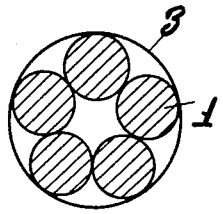
FIGS. 1 (*a*) and 1 (*b*) are cross sections of a conventional steel cords.
Figure 1:
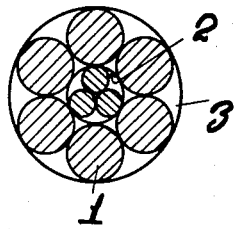

As mentioned above regarding Embodiments No. 1 and No. 2, a top end of the steel cord 3 comprising steel wires intertwisted by the conventional method is untwisted, and the individual steel wires are passed through the holes of the lay plate. By pulling individual steel wires in the direction of arrow A with the lay plate in a freely rotatable contition (FIGS. 4 (*a*) and 4 (*b*)), or by pulling them in the direction of arrow C while driving the lay plate positively in the same direction as the twist, i.e. in the direction of arrow B (FIGS. 5 (*a*) and 5 (*b*)), individual steel wires are twisted afresh by the lay plate as they are turning in the direction of arrow D or in the direction of arrow B and then are intertwisted again into an open cord 3*a*. Therefore, while the cross sectional shape of the steel cord 3 made by the conventional method is as shown in FIGS. 1 (*a*) or 1 (*b*), that of the open cord 3*a* made by the apparatus according to the present invention is as shown by FIGS. 3 (*a*) or 3 (*b*) and shows uniform spaces c between the steel wires. An open cord having the desired spaces between the steel wires can be obtained by proper choice of the spaces between the holes of the lay plate for twisting.

Since the open cord made by the method according to the present invention has uniform spaces between the steel wires and a stable twist construction, it is elastic, keeps its stranding and allows rubber to penetrate into the core and spread all over the surface of each steel wire, with the result of very strong adhesion between the wires and rubber.

Embodiment No. 3

As shown by FIG. 6, numeral 12 is a pay-off reel around which the steel cord 3 comprising a plurality of wires or strands intertwisted by a wire stranding machine is wound. Numeral 13 is a lay plate through which the steel cord passes as it is untwisted and has a plurality of small holes 14 of a number corresponding to the number of steel wires constituting the steel cord. It is desired that the small holes 14 are arranged at equal pitches around a circumference connecting the center of the small holes. The lay plate 13 may be made of hard material such as super hard metal or at least the surface of each small hole 14 must be made abrasion-resistant by surface hardening.

The lay plate 13 is fitted rotatably in an inner race of a bearing 16 through the medium of a brake ring 15 and when the steel cord 3 passes through the lay plate as it is intertwisted, the lay plate rotates freely, along with the brake ring 15, by the untwisting core. An outer race of the bearing 16 is secured to a machine base 17.

At the upper part of the periphery of the brake ring 15 is a groove, in which a brake band 18 such as a rubber braid, a rubber belt, a steel wire, or the like is inserted in slidable contact. One end of the brake band is secured to an adjusting screw 19. The adjusting screw 19 is set adjustably on a stay 20 fixed to the machine base 17. The brake ring 15, the brake band 18, the adjusting screw 19 and the stay 20 compose a frictional resistance device which controls the rolling friction of the lay plate.

Numeral 21 is a take-up reel which takes up an open cord which has passed through the lay plate 13. Pulling of an open cord can be effected, for example, by interposing a capstan roller (not shown in the drawing) between the lay plate 13 and the take-up reel 21.

An explanation is made below of the manufacture of an open cord by the above-mentioned apparatus.

The steel cord 3 wound around the pay-off reel 12 is drawn out at a prescribed tension, is untwisted into individual steel wires or strands, is pulled as the individual wires or strands are passed through the holes 14 and is twisted. Then the individual wires or strands are intertwisted again into an open cord 3*a*, which is wound around the take-up reel 21. At this time, the lay plate 13 turns at a speed which is determined by the speed of the cord (v m/min) and the lay length (l m.m.), namely, at m R.P.M. ($m=v/l\times10^3$).

The residual torsion of the open cord formed in the above manner tends to be negative when it is given twisting by the lay plate 13. But on the other hand, as the component force in twisting direction generated by the tensile force of open cord is small and rotation on its own axis of the lay plate 13 is hindered by the rolling friction of the bearing 16, the open cord is subjected to twisting force even if the lay plate 13 is turning and accordingly the residual torsion tends to be positive. In order to make good use of these two tendencies for obtaining the proper residual torsion, it is suggested to make the residual torsion tend to be negative by making the bearing 16 fit the lay plate beforehand or by lubricating the bearing 16 with oil of low viscosity to reduce the rolling friction resistance to the minimum possible, and then to shift the residual torsion to be positive while increasing the rolling friction resistance of the bearing 16 by the frictional resistance device. The trend of the relation between the rolling friction resistance of the bearing and the residual torsion is as shown by FIG. 7.

In FIG. 7, the axis of the ordinate is the degree of residual torsion of the cord and the axis of abscissa is the rolling friction moment (M) of the bearing. As can be seen from FIG. 7, when the rolling friction moment (M) of the bearing is small, residual torsion is also small and when M is large, residual torsion tends to be positive.

According to this embodiment, it has become possible to adjust the residual torsion during the manufacturing process of the open cord.

In each of the above embodments, the open cord is formed after the conventional steel cord is wound on a reel or adjustment of residual torsion is carried out, but it is possible to incorporate the device of the above embodiments into the conventional steel cord making apparatus such as a tubular type wire stranding machine or a buncher type wire stranding machine (double twisting wire stranding machine).

Embodiment No. 4

As shown in FIG. 8, instead of the brake ring of Embodiment No. 3 a ring 23 with a plurality of blades 22 fixed to the outer periphery thereof is fitted between the lay plate having a plurality of small holes (same composition as the lay plate in Embodiment No. 3) and the bearing. An air nozzle is disposed on the machine base 17 in which the bearing is fixed, in the face of the blade 22 and in a direction to hinder or aid the turning of the lay plate. Thus, a frictional resistance device is provided.

Under the above composition, the lay plate is turned with the passing of the cord therethrough but at the same time the air supplied from a pipe is blown from the air nozzle 24 toward the blades 22 and by this air current the rolling friction resistance to the bearing is adjusted, with resultant adjustment of the residual torsion of the cord.

Embodiment No. 5

As shown by FIG. 9, a ring having a disc 25 is fitted between the lay plate 13 having a plurality of small holes (the same composition as the lay plate in Embodiment No. 3) and the bearing. A permanent magnet or AC electromagnet 26 of shape formed in such a fashion that it nips the disc 25 is disposed on the machine base 17 in which the bearing is fitted. Thus, a frictional resistance device is provided.

Under the above composition, the lay plate 13 is turned with the passing of the cord therethrough but at the same time alternating current is sent to the AC electromagnet 26, whereby an alternating magnetic field is generated toward the disc 25 and a rolling frictional resistance is imparted to the bearing, with resultant adjustment of the residual torsion. According to the above device, adjustment of residual torsion can be achieved merely by arbitrary change of the magnet or by changing the voltage.

According to this embodiment, by disposing the lay plate with a frictional resistance device, formation of the open cord and adjustment of the residual torsion of the open cord can be effected easily. Thus, according to this embodiment open cords of stable quality can be manufactured on a mass production basis. Moreover, by incorporating the device into the conventional wire stranding machine open cords can be manufactured on a continuous production basis.

Embodiment No. 6

Figure 10A:
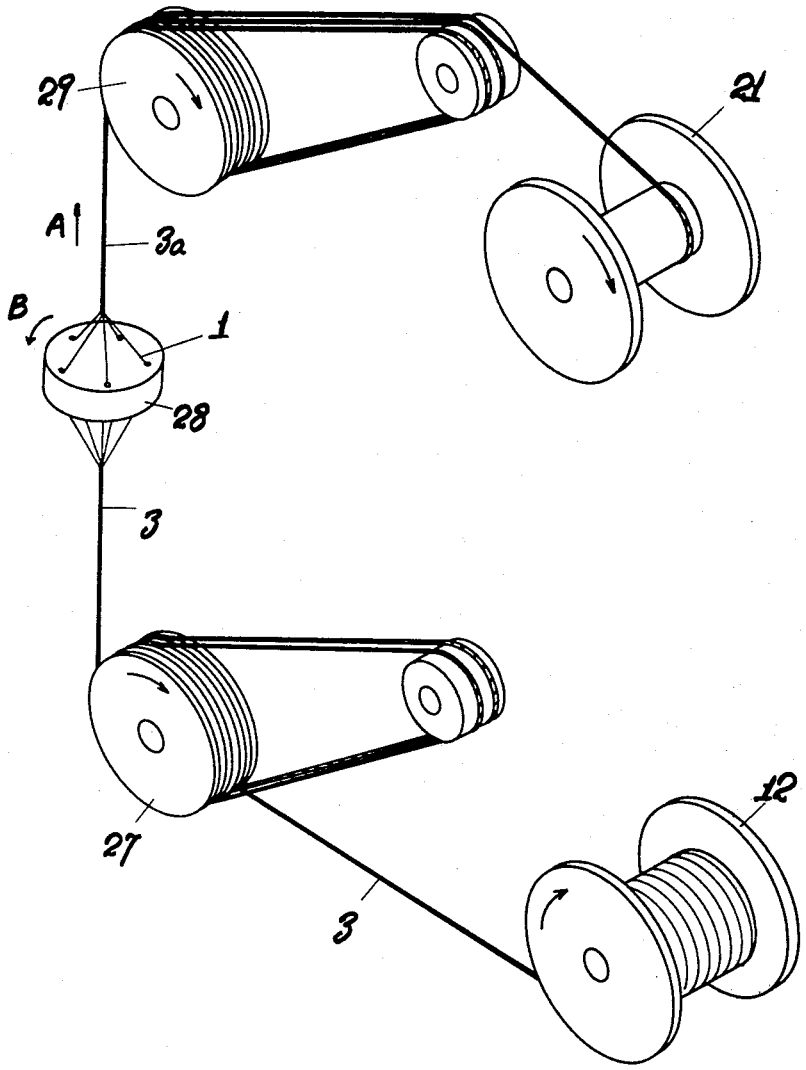
FIGS. 10 (*a*) and 10 (*b*) are respectively a schematic diagram of the manufacturing apparatus according to another embodiment the present invention and a perspective view of the main part thereof, on an enlarged scale.

In FIG. 10 (*a*), numeral 12 is a pay-off reel around which a steel cord is wound. Where necessary, this reel is provided with a brake device for the purpose of preventing overrun. Numeral 27 is a capstan around which steel cord 3 drawn out from the pay-off reel 12 is wound several times so that a proper back tension is given to the direction in which the steel cord advances. The capstan is driven by a torque motor. Numeral 28 is a lay plate to untwist the steel cord into individual steel wires 1 and to impart a desired twisting to the individual steel wires. The lay plate 28 is disposed rotatably by using a bearing or is turned by giving a proper torque. Numeral 29 is a pulling capstan to pull the open cord 3*a*, which has passed through the lay plate 28 and has been intertwisted again, at a regular speed in the moving direction. This pulling capstan is driven by a motor. Numeral 21 is a take-up reel to take up the open cord 3*a*. This take-up reel is driven by a torque motor or by the conventional driving device.

A plurality of grooves are made on at least one roll each of the capstans 27, 29 to prevent slipping of the cord. A plurality of holes of a number corresponding to the number of steel wires of the steel cord are made in the lay plate 28. These holes are made up of abrasion-resistant material or are subjected to surface treatment for abrasion-resistance.

In the device of the above-mentioned construction, the steel cord 3 comprising intertwisted steel wires wound around the pay-off reel 12 is drawn out at a constant drawing out tension by the capstan 27 and is untwisted by the lay plate 28. Then, by pulling the open cord 3*a* in the direction of arrow A by the pulling capstan 29, the component force to turn the lay plate in the direction of arrow B (if the cord is of S lay) or in the opposite direction (if the cord is of Z lay) is achieved, whereupon the lay plate 28 begins to turn. With the turning of the lay plate 28, the steel cord is untwisted on the entrance side, but on the exit side the untwisted steel wires are twisted as they are advancing and are intertwisted again into an open cord 3*a* of a properly soft twist having spaces between the steel wires. The proper softness of twist (degree of openness) should vary according to the state in which the open cord is used or the condition under which it is used. In the apparatus according to the present invention, adjustment of the softness of twist can be made perfectly by adjusting the size of the diameter D of the pitch circle of the holes of the lay plate 28, the cross sectional shape of the edge of the hole and the value of the steel cord tension which can be adjusted by the capstan 27 for controlling the steel cord tension. If the diameter D of the pitch circle of the holes of the lay plate 28 is made larger, the degree of openness of twist becomes larger (this means that the space c in FIG. 3 becomes larger) and if it is made smaller, the degree of openness of twist becomes smaller. If the cross sectional shape of the hole edge on the entrance side or the exit side is made sharper, the degree of openness of twist becomes larger and if it is made gentler, the degree of openness of twist becomes smaller. If the steel cord tension is made stronger, the degree of openness of twist becomes larger but if it is made weaker, the degree of openness of twist becomes smaller.

In actual manufacture, it is recommended to select the desired degree of openness by combining properly the type of steel cord and the above-mentioned conditions. It should be noted that if the diameter D of the pitch circle of the holes of the lay plate is made too large, the component force of the tensile strength of the steel cord is, in some cases, smaller than the force to turn the lay plate. In such cases, therefore, a force to drive the lay plate positively must be provided. Such driving torque affects the softness of twist.

As mentioned above, a steel cord twisted by the conventional wire stranding machine can easily be made into open cord by using the apparatus of this embodiment.

Embodiment No 7.

Referring to FIG. 11, numeral 12 is a pay-off reel around which is wound the steel cord 3 comprising a plurality of steel wires or strands intertwisted by a wire stranding machine, and the steel cord 3 is drawn out from this reel. Numeral 30 is a lay plate through which steel cord 3 is passed as it is untwisted. This lay plate 30 has small holes 31 of a number corresponding to the number of steel wires or strands constituting the cord. It is desired that the small holes 31 be disposed at equal pitche on a circumference connecting the centers of the small holes. The lay plate 30 is made of super hard metal or the like or at least the surfaces of small holes 31 must be abrasion-resistant, for example, by subjecting to surface hardening.

Numerals 32 and 33 denote, bearings. A pulley 34 is fitted between the outer race of the inner bearing 32 and the inner race of the outer bearing 33. The lay plate 30 is secured to the inner race of the inner bearing 32 and the outer race of the outer bearing 33 is secured to a machine frame 35. The pulley 34 has at the lower part of its outer periphery a groove in which a belt 36 is fitted. The pulley can be driven at a high speed or a low speed, either in a normal or a reverse direction, by a two-way variable speed driving device 37 through the medium of the belt 36.

Numeral 21 is a take-up reel which takes up the open cord 3*a* which has passed through the lay plate 30.

An explanation is made below of the manufacture of open cords by the manufacturing apparatus of the above-mentioned construction.

The steel cord 3 is drawn out at a prescribed tension from the reel 12 by a capstan roller (not shown in the drawing) or the like and is untwisted into individual steel wires or strands, which are passed through small holes 31 of the lay plate 30 and are twisted. The twisted individual steel wires or strands are intertwisted again into an open cord 3*a*, which is taken up by take-up reel 21. At this time, the lay plate 30 generally turns at a revolution speed of m R.P.M. which is determined by the speed of the cord v m/min. and the lay length of the steel cord l m.m., namely, $m=v/l\times 10^3$. In reality, however, as the component force in the twisting direction generated by pulling of the open cord is small, the rotation of the lay plate on its axis is hindered even by a slight rolling friction of the bearing by grease, retainer, etc. and even if the lay plate turns, torsion is applied to the open cord and the residual torsion of the open cord tends to be positive. It is therefore necessary to adjust the residual torsion toward the negative. The trend of the relation between the revolution of the lay plate and the degree of residual torsion is as shown by FIG. 12. In FIG. 12, the axis of the ordinate is the degree of residual torsion of the open cord and the axis of the abscissa is the rolling friction moment M of the inner bearing. As can be seen from FIG. 12, if the rolling friction moment M of the bearing is small, the residual torsion tends to be negative and if it is large, the residual torsion tends to be negative. In this embodiment, therefore, pulley 34 is turned in the turning direction of the lay plate 30 by a driving device 37 and the turning speed of the lay plate 30. By increasing the turning speed of the pulley still further in excess of the turning speed of the lay plate 30, rotation of the lay plate 30 on its axis is backed up and torsion applied to the open cord is reduced, whereby the residual torsion is adjusted towards the negative. FIG. 13 shows the trend of the relation between the revolution of the pulley and the rolling friction moment of the inner bearing. In FIG. 13, the axis of the ordinate is the revolutionary direction of the pulley and the axis of the abscissa is the rolling friction moment M of the inner bearing. As can be seen from FIG. 13, if the revolutionary direction of the pulley is normal, the rolling friction moment of the inner bearing is small, but if the former is reverse, the latter is large.

According to the manufacturing apparatus of this embodiment, by adjusting the revolution of the pulley 34 very slight irregularity of revolution due to irregularity of twisting or the feeding speed is absorbed and troubles such as breakage of the wire does not occur. Even if the lay plate hardly rotates on its own axis at the start of operation, it begins to turn immediately by the pulley 34 and therefore a very smooth start is possible. The effect can be obtained at the stop of operation.

Embodiment No. 8

Figure 14:
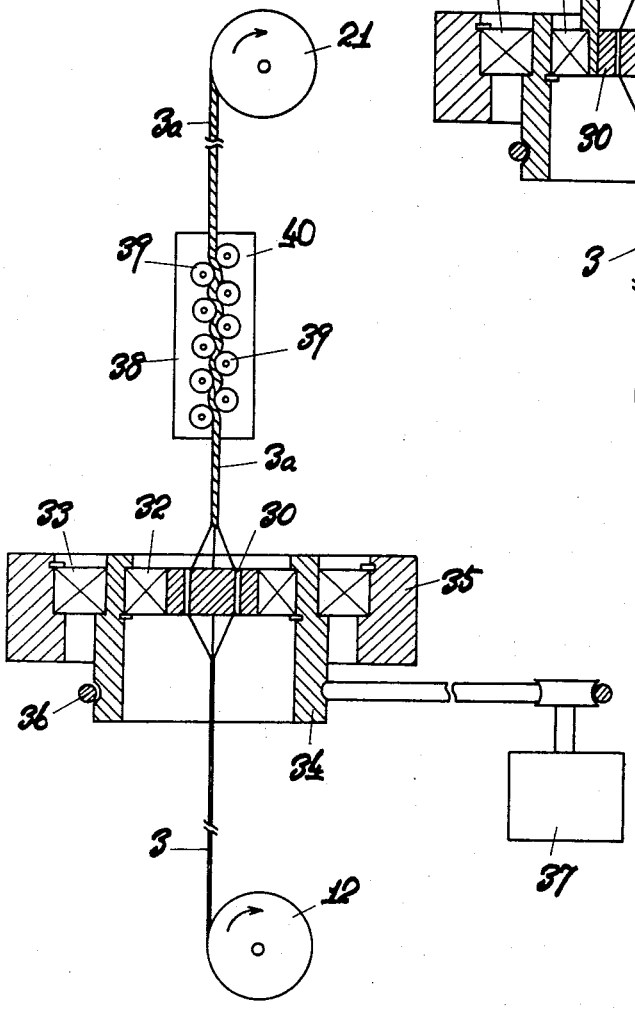
FIG. 14 is a sectional side view of the main part of another embodiment.

As shown by FIG. 14, a rectifying device 40 having a plurality of rollers 39 of small diameter which are arranged rotatably adjustably and in a zigzag manner on a machine base 38 is disposed between the lay plate 30 composed similarly to that of Embodiment No. 7 and the take-up reel 21 and in succession to the lay plate. Thus, an apparatus for manufacturing open cords is formed.

According to the above-mentioned apparatus, when forming the open cord the degree of twist of the open cord which is formed after passing through the lay plate 30 is adjusted by the rectifying device 40 and uniform open cords can be obtained. When the open cord is passed through the rectifying device 40, residual torsion tends to be positive. Therefore, it is necessary to adjust the residual torsion of the open cord which has passed through the lay plate 30 towards the negative. For this purpose, rotation of the pulley 34 should be made larger in normal rotation so as to decrease the rolling friction moment of the inner bearing.

Embodiment No. 9

Figure 15:
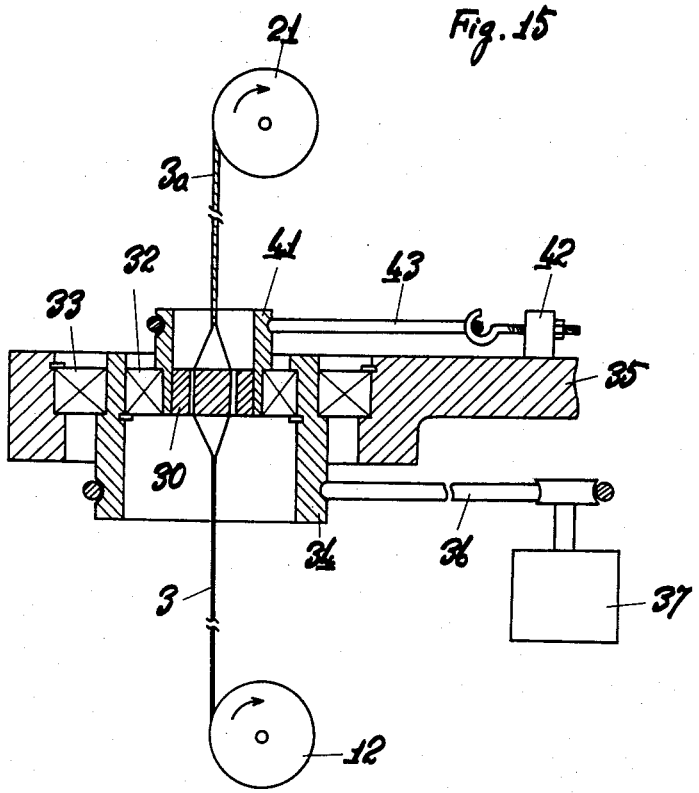
FIG. 15 is a sectional side view of the main part of another embodiment.

As shown by FIG. 15, the apparatus for manufacturing open cords is formed by providing the apparatus of Embodiment No. 7 further with a brake ring 41 fixed between the inner race of the inner bearing 32 and the lay plate 30 and a brake band 43 positioned in a groove made at the upper part of the outer periphery of the brake ring, with its one end of band 43 fixed to a fixing piece 42. The brake band 43 may be a rubber braid, leather belt, rubber belt, etc. and can be fixed to the fixing piece 42 through the medium of an adjusting screw. Use of this apparatus is most suitable for adjusting the residual torsion of the open cord towards the positive to a large extent, namely, residual torsion is adjusted towards the positive by turning the pulley 34 in a direction contrary to the rotational direction of the lay plate 30 so as to raise the rolling friction moment of the inner bearing and by giving resistance to the rotation of the lay plate by the brake ring 41.

According to the manufacturing apparatus of this embodiment, since the lay plate is fitted in the double bearing and the rolling friction moment of the inner bearing is changed by controlling the rotation of the pulley disposed between the bearings, adjustment of the degree of residual torsion and openness can be made freely and irregularity of twist during the period from the start of operation, to the stop of operation and the troubles in operation such as breakage of the wire can be eliminated, with the result of improved quality, improvement of productivity and decrease of the number of processes.

Embodiment No. 10

Figure 16A:
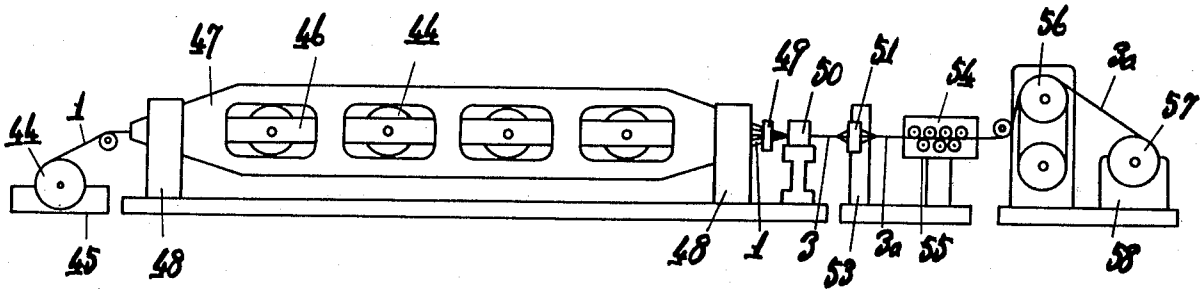
FIGS. 16 (*a*) and 16 (*b*) are respectively a rough side view and of a cross section of the main part of another embodiment.
Figure 16:
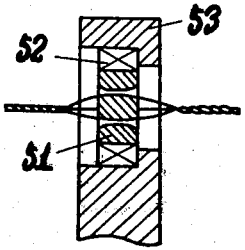

Referring to FIG. 16 (*a*), numeral 44 is a reel around which a steel wire 1 is wound. This reel is mounted rotatably on a drawing out stand 45 or a cradle 46. The cradles 46 of a number corresponding to the number of steel wires are set on a rotating tube 47. The cradles 46 are stationary or swingable in relation to the rotation of the rotating tube 47. The rotating tube 47 is supported pivotally by a machine base 48 through the medium of bearings. Numeral 49 is a guide for steel wires 1 drawn out from the rotating tube 47 and numeral 50 is a die which is the converging point of wires 1 or the starting point of twisting. This die 50 has a hole through which the wires pass in tight contact with each other and is secured to the machine base. Numeral 51 is a lay plate which is a disc made up of super hard metal or hard material having a plurality of small holes (preferably of a number corresponding to the number of steel wires constituting a cord) spaced apart at regular intervals on a circumference connecting the centers of the small holes. As shown in FIG. 16 (*b*), the lay plate is fitted rotatably to a machine base 53 through the medium of a bearing 52. According to circumstances, the lay plate may be provided with a device which assists rotation of the lay plate positively or which applies a braking force. The lay plate 51 may be a metal plate having small holes which have been subjected to a surface hardening treatment.

Numeral 54 is a rectifying device which is composed of a plurality of fluted rollers 55 of small diameter which are rotatable freely and opposite to each other in a zigzag arrangement. All rollers of small diameter or at least the rollers of small diameter on the entrance side are fitted to a fitting plate in such a fashion that they are adjustable in position upward and downward or upward, downward, leftward and rightward. Numeral 56 is a pair of fluted capstan rollers which are driven with an open cord wound thereon several times. Numeral 57 is a reel for taking up the open cord which is mounted on a take-up device 58. Thus, an apparatus for manufacturing open cords is provided.

An explanation is made below about the twisting action by the above-mentioned apparatus.

Steel wires 1 drawn out from a plurality of reels 44 of a number corresponding to the twist construction pass through the guide 49 and are twisted into a steel cord 3 at the die 50 by the rotation of the rotating tube 47. The steel cord thus made is untwisted into individual steel wires, which are passed through the lay plate 51 and intertwisted into an open cord having a twisting tendency and a tendency to have spaces C between the steel wires as shown by FIG. 3 (*a*) and (*b*). At this time, the lay plate 51 is rotatable by means of the bearing 52 and turns naturally at the speed as shown below and the steel wires drawn out of the lay plate 51 are again intertwisted.

$$m = v/l \times 10^3$$

m: lay plate revolution speed r.p.m.
v: linear speed m/min.
l: lay length m.m.

At this time, as the lay plate is given torque by a slight component force in the torsional direction of the tension of the open cord, in the case where smooth rotation cannot be obtained and the frictional moment of the bearing 52 affects the residual torsion and the degree of openness, the lay plate 51 may be turned positively by a torque motor or may be provided with a braking device, etc.

The steel cord 3 which passed through the lay plate 51 is formed into an open cord 3*a*. However, as it is difficult to correspond the degree of the space C between steel wires (degree of openness) to the target degree, it is usual that the processing is done with some allowance, but in this case the residual torsion tends toward the negative. Therefore, in order to adjust the degree of openness C and to adjust the residual torsion towards the positive, the open cord 3*a* is passed through the rectifying device 54. Adjustment of the degree of openness and the residual torsion is done by adjusting the position of rollers 55 of small diameter on the fitting plate. The open cord 3*a* which has been subjected to the stranding process on a continuous basis is taken up by the fluted capstan rollers 56 and further taken up by the reel 57.

Figure 17:
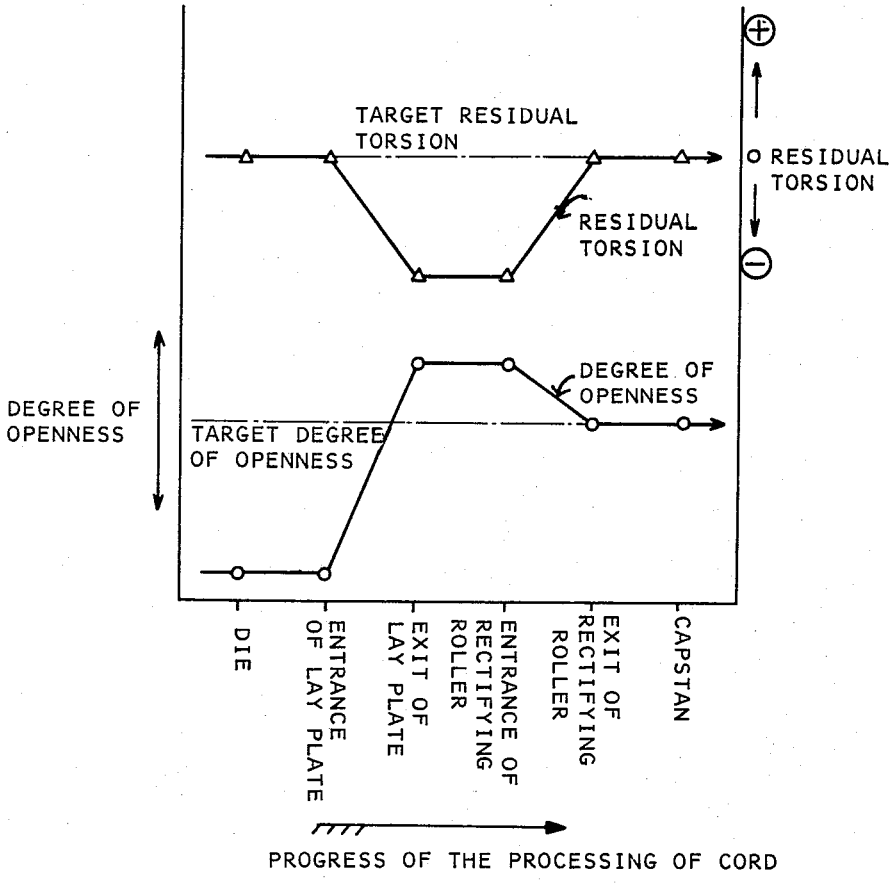
FIG. 17 is a diagram illustrating the change of quality according to the progress of the manufacturing process of the cord.

FIG. 17 shows the changes of quality according to the progress of the processing of the cord.

According to this embodiment, steel wires are converged at the die for twisting at the prescribed pitch into a cord, but at the lay plate the cord is untwisted into individual steel wires for twisting and twisted individual steel wires are intertwisted into an open cord, which is adjusted in the degree of openness and residual torsion by the rectifying device. Thus, open cords of good quality and stable openness can be manufactured on a continuous basis.

Embodiment No. 11

Figure 18:
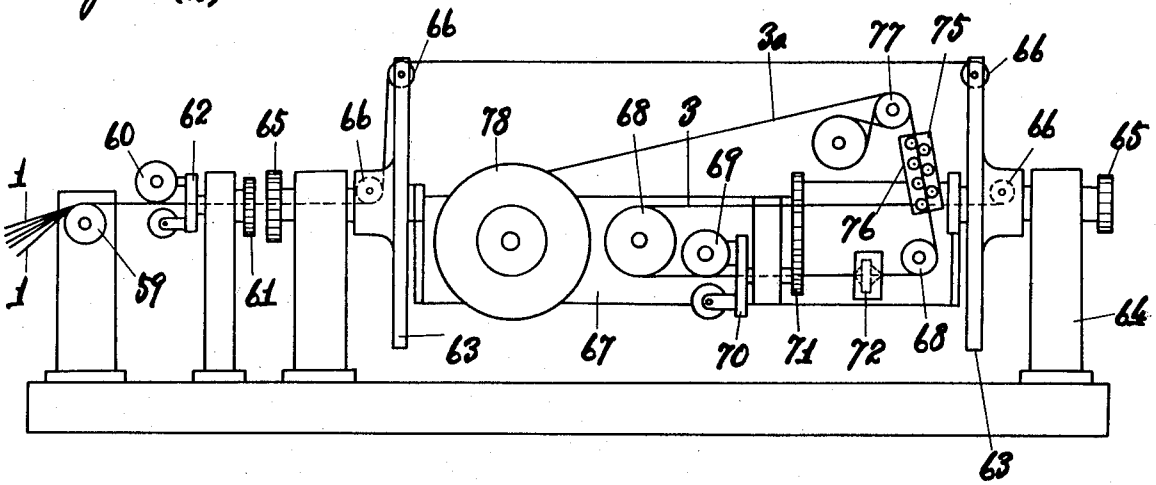
FIGS. 18 (*a*) and 18 (*b*) are respectively a rough side view and a cross section of the main part of another embodiment.
Figure 18:
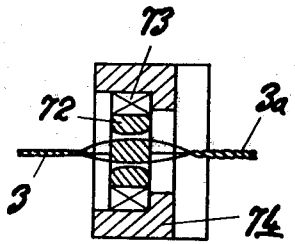

As shown by FIG. 18(*a*), numeral 1 is a steel wire which is to be part of a steel cord 3 and is supplied from a supply reel (not shown in the drawing). Numeral 59 is a twist starting roller to converge the steel wires. This roller is fixed rotatably to the machine base, and preferably has a spiral groove in which steel wires 1 are wound around several times. Numeral 60 is a false twisting roller to impart preliminary twist to steel wires. This roller is fitted rotatably to a bracket 62 which is driven by a timing pulley 61. Numeral 63 is a flyer which is turned and driven by a timing pulley 65 through the medium of bearings. Numeral 66 denotes a guide roller for a steel cord disposed rotatably to the flyer 63. Numeral 67 denotes a cradle hung on the flyer 63 through the medium of bearings in such a fashion that it is stationary or swingable in relation to the flyer 63. Numeral 68 denotes a turn roller which turns in the direction in which the cord progresses. The turn roller is mounted rotatably on the cradle 67. Numeral 69 is an overtwist roller to give overtwist to the steel cord 3 which has been twisted twice. This roller is secured rotatably to a bracket 70. The bracket 70 is mounted on the cradle 67 through the medium of bearings and is driven positively by a gear 71. Numeral 72 is a lay plate disposed rotatably on the cradle 67. The lay plate 72 which is disposed at the rear of the overtwist roller 69 is formed by a disc of super hard metal or hard material having a plurality of small holes (preferably, of a number corresponding to the number of steel wires constituting the cord) of such shape that twisting can be imparted to the steel wires when passing therethrough and which are spaced apart at regular intervals on a circumference connecting the centers of the small holes. The lay plate 72 is fitted rotatably to a fitting frame 74 through the medium of bearing 73. According to circumstances, the lay plate 72 may be provided with such device which backs up rotation of the lay plate positively or imparts a braking force to the lay plate. It is possible to form the lay plate 72 by making small holes in a metal plate and by applying a surface hardening treatment to the small holes.

Numeral 75 is a rectifying device comprising a plurality of freely rotatably fluted rollers 76 of small diameter arranged opposite to each other in zigzag arrangement. All of these rollers 76 of small diameter or at least the rollers 76 of small diameter on the entrance side of the steel cord are fitted to a fitting plate adjustable upward and downward or upward, downward, leftward and rightward. Numeral 77 is a pair of fluted capstan rollers which are driven by a gear for taking up the cord. Numeral 78 is a take-up roller mounted on a taking up device. This take-up roller takes up a finished open cord 3*a*. An apparatus for manufacturing open cords is composed by the above-mentioned arrangement.

An explanation is made below of the twisting action by the above-mentioned apparatus.

Steel wires 1 drawn out from supply reels of a number corresponding to the twisting construction are paralleled by the twist starting roller 59, are given false twist of a prescribed lay length by the false twisting roller 60, pass through the hollow axis of the flyer 63, are guided to the guide roller 66, pass through the hollow axis of the opposite flyer 63 and are led into the flyer 63. Steel wires led into flyer 63 are given twist of two times the rotation of the flyer and are formed into a steel cord 3. The steel cord 3 which was given double twist is passed on the overtwist roller 69 for the purpose of stabilizing the repulsion of twist.

By passing on the overtwist roller 69, the steel cord 3 is given a stable twist. By passing through the lay plate 72 steel wires which have already been given a twisting tendency are further given a tendency to open due to the cross sectional shape of the hole edges of the small holes made in the lay plate 72 and the tension of the open cord. At this time the lay plate 72 is rotatable by the bearing 73 and turns naturally at the speed shown below, and steel wires which pass through the lay plate 72 are again intertwisted.

$$m = v/l \times 10^3$$

where m: lay plate revolution speed r.p.m.

v: linear speed m/min.

l: lay length m.m.

At this time, as the lay plate is given a torque by a slight component force in the torsional direction in the tension of the open cord, in the case where smooth rotation is not obtained or the friction moment of the bearing 73 affects the residual torsion and the degree of openness, the lay plate 72 may be turned positively by a torque motor or a braking device may be provided. Then, the steel cord passes through the lay plate and is formed into an open cord. As it is difficult to correspond the degree of openness of the open cord to the target degree, processing is usually done with some allowance. At this time, as the residual torsion tends to be negative, the open cord is passed through the rectifying device 75 to adjust the degree of openness and to adjust the residual torsion. Adjustment of the degree of openness and the residual torsion is done by adjusting the position of the fluted rolls 76 of small diameter on the fitting plate. The open cord thus processed for stranding on a continuous basis is wound up by fluted capstan roller 77 and is taken up by reel 78.

Figure 19:
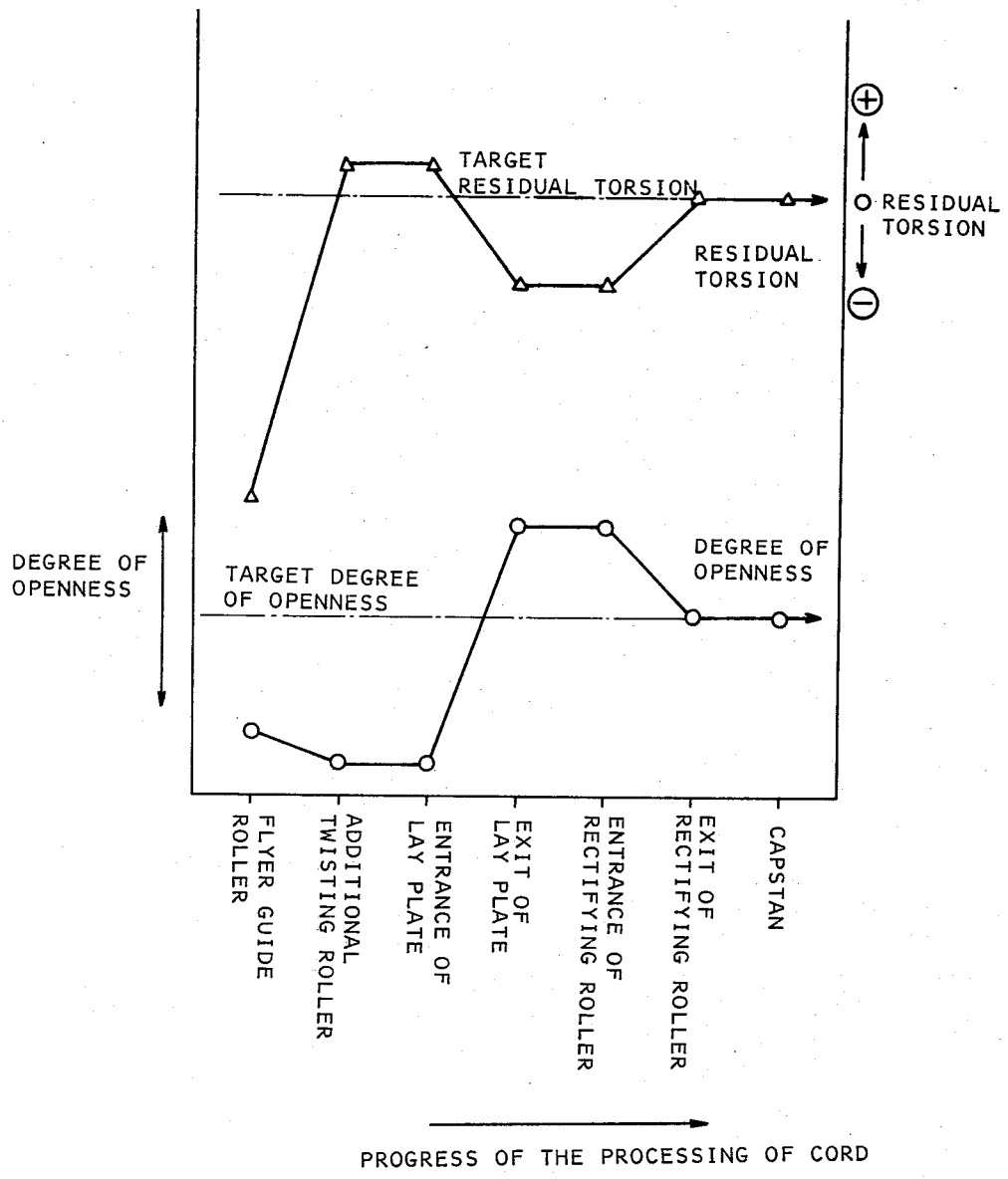
FIG. 19 is a diagram showing the change of quality according to the progress of the manufacturing process of the cord.

FIG. 19 shows the changes of quality according to the progress of the processing of the cord.

According to the above embodiment, it is possible to manufacture open cords of stable quality, free from residual torsion, at high productivity. Embodiments which are different from the above-mentioned embodiment but produce the same effect are discussed below.

Figure 20:
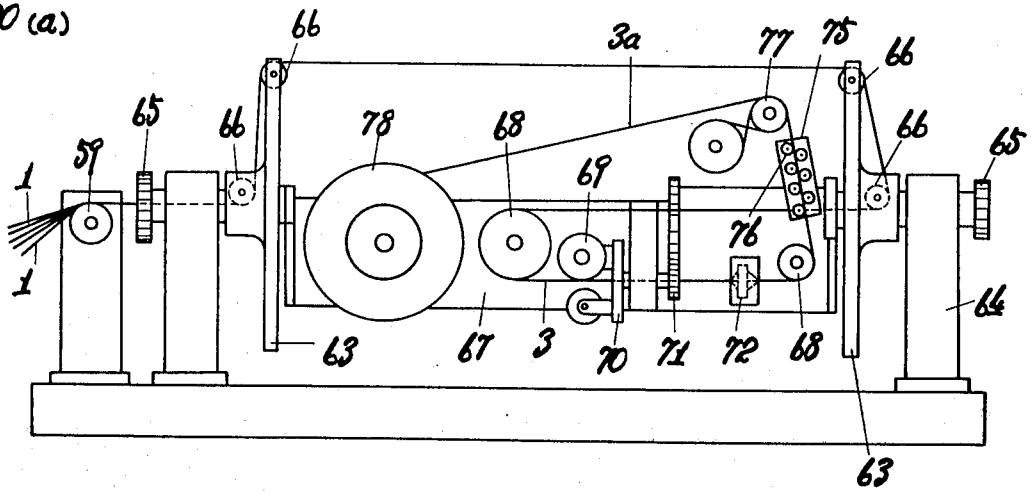
FIGS. 20 (*a*), 20 (*b*), 20 (*c*), 21, FIG. 22 (*a*) and 22 (*b*) are schematic views showing various modifications of another embodiment.
Figure 20:
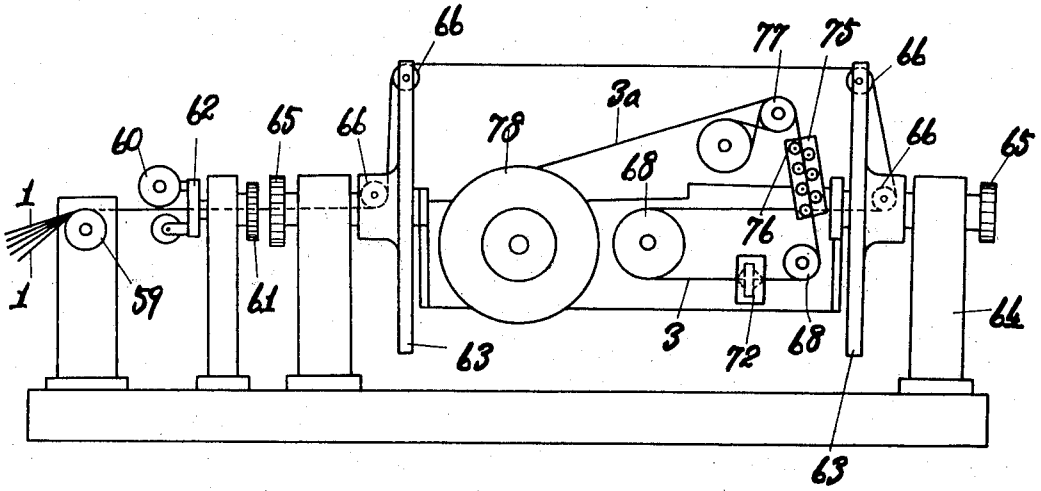
Figure 20:
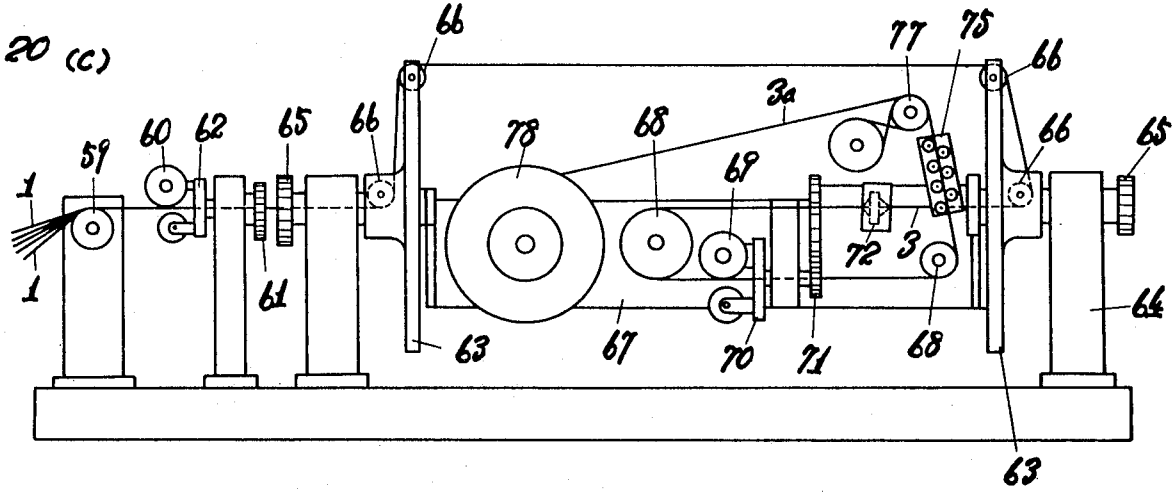

The embodiment shown by FIG. 20 (*a*) is the same as that shown by FIG. 18, with the exception that the false twisting roller is omitted in the former. However, by adjusting the revolution speed of the overtwist roller 69 disposed in the cradle, an open cord of equal quality can be obtained from the former.

The embodiment shown by FIG. 20 (*b*) is the same as that shown by FIG. 18, with the exception that the overtwist roller 69 is omitted in the former. However, by adjusting the revolution speed of the false twisting roller 60, an open cord of equal quality can be obtained.

The embodiment shown by FIG. 20 (*c*) is the same as that shown by FIG. 18, with the exception that in the former the lay plate 72 is disposed between the guide roller 66 and the turn roller 68 which is in front of the overtwist roller 69. Under this arrangement, overtwist is given to the cord after the degree of openness is adjusted, and therefore open cords of an improved degree of openness can be obtained.

Figure 21:
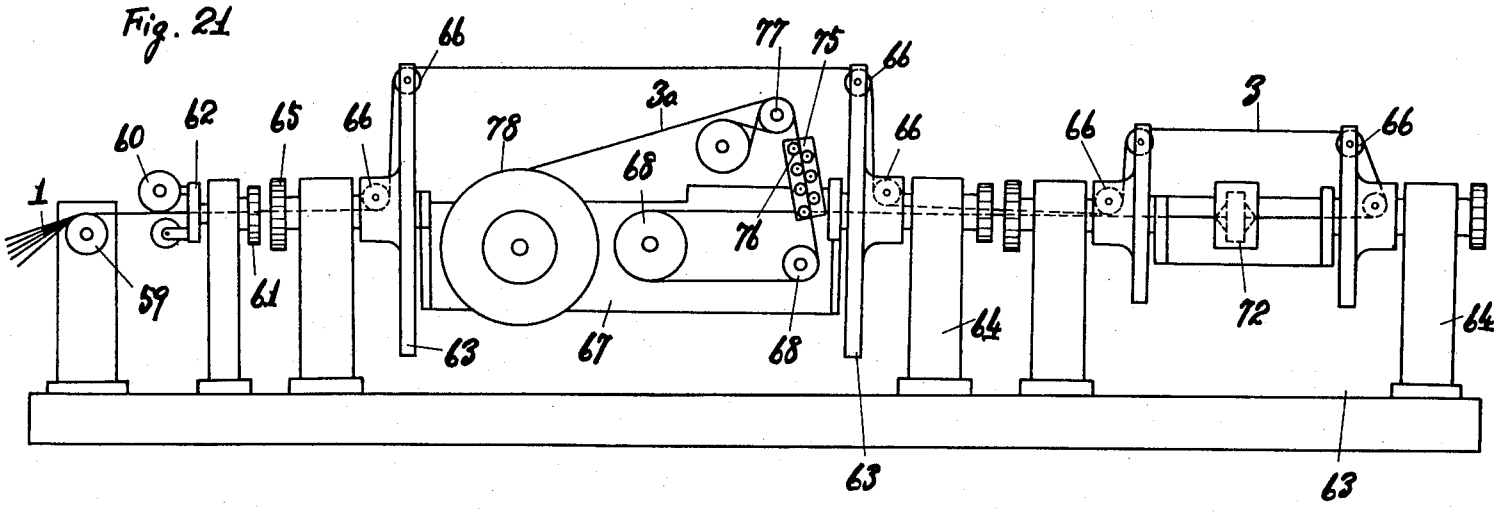

The embodiment shown by FIG. 21 is the same as that shown by FIG. 18, with the exception that in the former a supplementary flyer is arranged to the flyer 63 and the lay plate 72 is mounted on the cradle in the supplementary flyer. Under this arrangement, the steel cord which has been given a twisting tendency is untwisted and then given a first twist and a second twist and is passed through the lay plate. Therefore, open cords of stable lay length, free from irregularity of twist, can be obtained.

Figure 22:
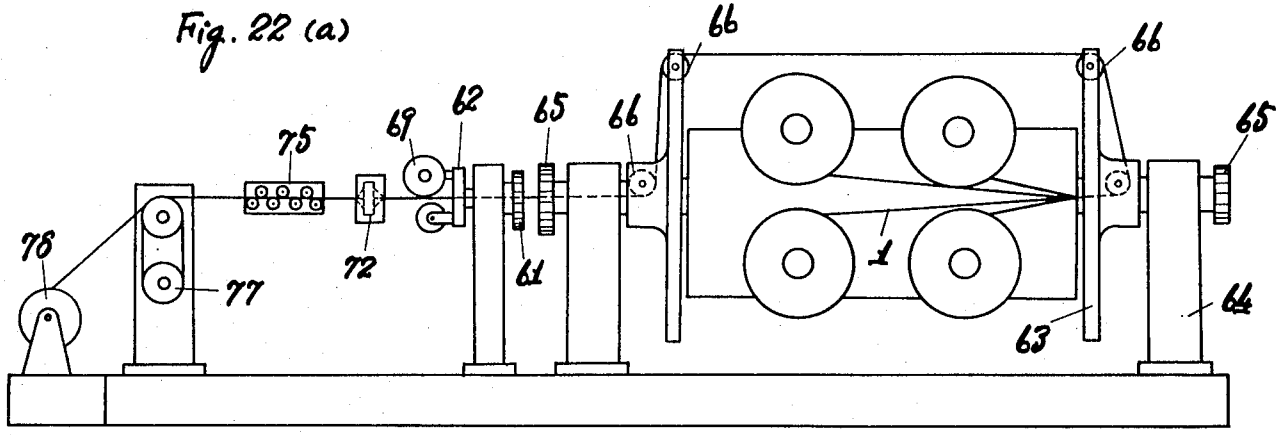
Figure 22:
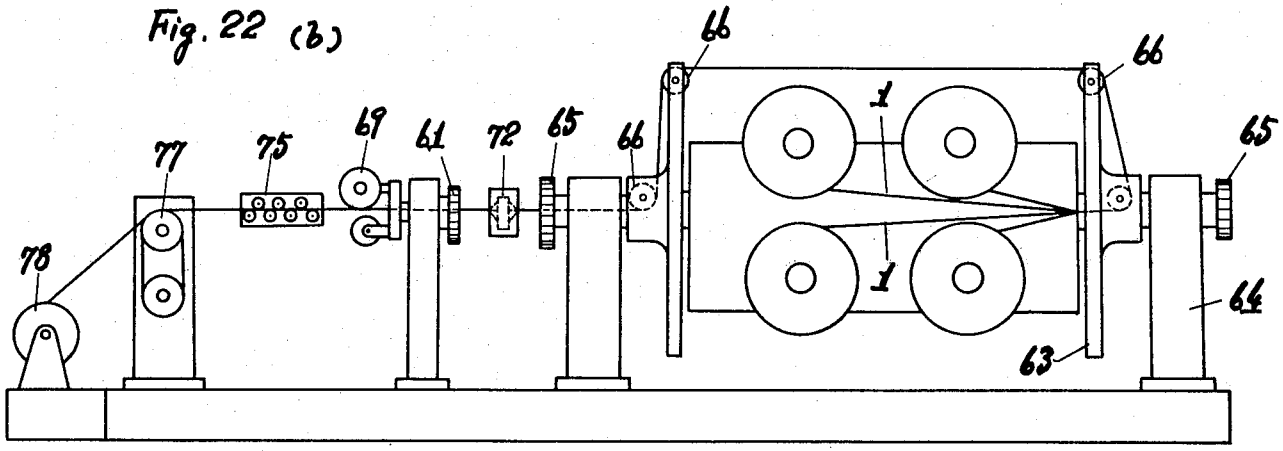

FIGS. 22 (*a*) and 22 (*b*) show a buncher type stranding machine which takes up an open cord outside the cradle. FIG. 22 (*a*) shows that, with respect to the advancing direction of the cord, the lay plate 72 is disposed in succession to the overtwist roller 69 and FIG. 22 (*b*) shows that, with respect to the advancing direction of the cord, the overtwist roller 69 is disposed in succession to the lay plate 72.

Since these two embodiments are of the above-mentioned construction, a steel cord which has been given twist two times is passed through the lay plate, without being taken up, and is then passed through the rectifying device. Therefore, open cords of good and stable quality (in the degree of openness and residual torsion) can be obtained and productivity is improved to a large extent.

Embodiment No. 12

Figure 23:
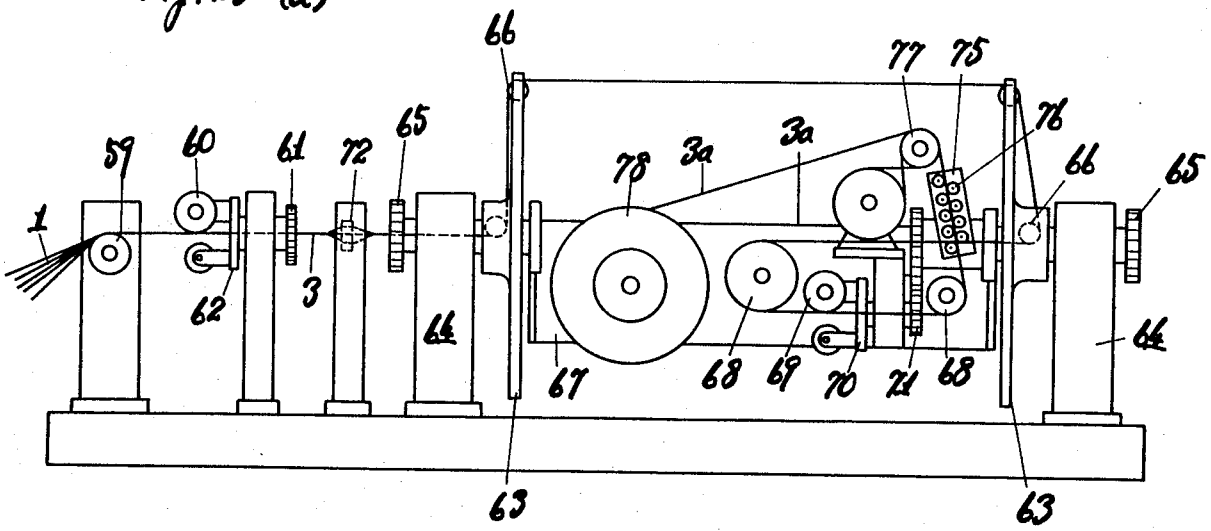
FIGS. 23 (*a*) and 23 (*b*) respectively a schematic diagram and a cross section of the main part of another embodiment.
Figure 23:
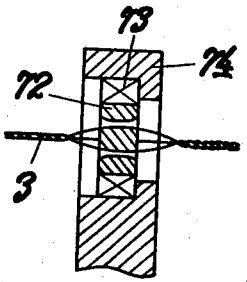

As shown by FIG. 23 (*a*), numeral 1 is steel wire to be part of a steel cord 3. The steel wire is supplied from a supply reel (not shown in the drawing). Numeral 59 is a twist starting roller to converge steel wires 1. This roller is fitted rotatably to a machine base, and preferably has a spiral groove in which the steel wires are wound round several times. Numeral 60 is a false twisting roller to impart a preliminary twisting tendency to steel wires 1. This roller is fitted rotatably to a bracket 62 which is driven by a timing roller 61. Numeral 72 is a lay plate comprising a disc of super hard metal or hard material having a plurality of small holes (preferably of a number corresponding to the number of steel wires constituting a cord) of such shape that the steel wires are given twisting tendency when passing therethrough, and spaced apart at regular intervals on a circumference connectng the centers of the small holes. As shown by FIG. 23 (*b*), the lay plate is fitted rotatably to a fitting frame 74 through the medium of bearings 73. According to circumstances, the lay plate 72 may be provided with a device which backs up the rotation positively or which applies a braking force. The lay plate 72 may be made of a metal sheet in which small holes subjected to a surface hardening treatment are made. Numeral 63 is a flyer which is turned and driven by a timing pulley 65 through the medium of bearings. Numeral 66 is a guide roller disposed rotatably on the flyer 63. Numeral 67 is a cradle which is hung on the flyer 63 through the medium of bearings in such a fashion that it is stationary or swingable in relation to the flyer 63. Numeral 68 is a turn roller which converts the advancing direction of the steel cord 3 and which is disposed rotatably on the cradle 67. Numeral 69 is an overtwist roller to give an overtwist to the steel cord 3 which has been given a double twist. This roller is fitted rotatably to a bracket 70 which is disposed in the cradle 67 through the medium of bearings and is driven positively by a gear 71. Numeral 75 is a rectifying device comprising a plurality of rotatable fluted rollers 76 of small diameter arranged opposite to each other in a zigzag manner. This device is disposed in the cradle 67. All of the rollers of small diameter or at least the rollers of small diameter on the entrance side of the steel cord are adjustable upward and downward or upward, downward, leftward and rightward. Numeral 77 is a pair of fluted capstan rollers which are driven by a gear for winding up the cord. Numeral 78 is a take-up reel disposed on a taking up device. This reel takes up a finished open cord. An apparatus for manufacturing open cords is composed by the above-mentioned arrangement.

An explanation is made below of the twisting action by the above-mentioned apparatus.

Steel wires 1 drawn out from the supply reels of a number corresponding to the twist construction are paralleled by the twist starting roller 59 and are given a false twist of a predetermined lay length by the false twisting roller 60 which turns at a speed 2–2.8 times faster than the revolution speed of the flyer 63. The steel cord 3 which passes the temporary or false twisting roller 60 is imparted with a so-called false twist. By untwisting the false twisted steel cord and passing the individual steel wires through the small holes of the lay plate 72, the individual steel wires are given the trend to open due to the cross sectional shape of the hole edges of the small holes in the lay plate 72 and the tension of the open cord. At this time, the lay plate 72 is rotatable by the bearing 73 and turns naturally at the speed shown below, and steel wires which pass through the lay plate 72 are again intertwisted.

$$m = v/l \times 10^3$$

m: lay plate revolution speed r.p.m.
v: linear speed m/min.
l: lay length m.m.

At this time, as the lay plate is given a torque by a slight component force in the torsional direction in the tension of the open cord, in the case where smooth rotation was not obtained or the friction moment of the bearing 73 affects the residual torsion and the degree of openness, the lay plate 72 may be turned positively by a torque motor or a braking device may be provided.

The open cord 3*a* which passes through the lay plate 72 and has been given a trend to open passes through the hollow axis of the flyer 63, is led to the guide roller 66, passes through the hollow axis of the opposite flyer 63, is led into the flyer 63, joins the regular twist by the rotation of the flyer and is taken up by the take-up reel 78 on the cradle, during which the open cord 3 passes the overtwist roller 69 and the rectifying device 75. At the overtwist roller 69 the steel cord 3 is given a stable twist and at the rectifying device 75 residual torsion caused by the opening process given by the lay plate is removed for adjustment of quality.

Since the manufacturing apparatus of this embodiment is of the above-mentioned construction, steel wires are given previously a twisting tendency by the false twisting roller 60 and are further given a tendency to open by passing through the lay plate 72. Therefore, when steel wires enter into the cradle and are given a double twist, they are given the opening process and are made into an open cord having the desired degree of openness. Moreover, since the open cord is produced on a continuous basis by using a double twisting wire stranding machine of high productivity, complicated maintenance work is not required and productivity is improved to a large extent.

What we claim is:

1. An apparatus for manufacturing an open cord formed of a plurality of wire strands which are intertwisted evenly with spaces therebetween, said apparatus comprising:

a machine base;

feed reel means for feeding a plurality of wire strands;

a twist starting roller for converging said wire strands drawn from said feed reel means;

a false twisting roller for imparting twisting strains to said converged wire strands;

a cradle swingably mounted between a pair of flyers positioned oppositely, rotatably and drivably on said machine base, said converged wire strands being twisted twice by said flyers to form a cord;

an overtwist roller mounted on said cradle for imparting an overtwist to said cord which has been twisted twice;

a captan and a take-up reel for taking up said cord; and a lay plate fixed with respect to an inner race of a bearing means having an outer race fixed with respect to said machine base, said lay plate having therein a plurality of holes through which respective of said wire strands pass, such that said lay plate is rotatable within said bearing means by passage of said wire strands through said holes, said holes being equally spaced around a circumference passing through the centers of said holes.

2. An apparatus as claimed in claim 1, wherein said lay plate is positioned immediately downstream of said false twisting roller, with respect to the direction of movement of the cord through the apparatus.

3. An apparatus as claimed in claim 1, wherein said lay plate is positioned immediately downstream of said overtwist roller, with respect to the direction of movement of the cord through the apparatus.

4. An apparatus as claimed in claim 1, wherein said lay plate is positioned upstream of said overtwist roller, with respect to the direction of movement of the cord through the apparatus.

5. An apparatus for manufacturing an open cord formed of a plurality of wire strands which are intertwisted evenly with spaced therebetween, said apparatus comprising:

a machine base;

a cradle swingably mounted between a pair of flyers positioned oppositely, rotatably and drivably on said machine base, said wire strands being bunched and twisted twice by said flyers to form a cord;

an overtwist roller mounted separately from said cradle for imparting an overtwist to said cord which has been twisted twice;

a capstan and a take-up reel, mounted separately from said cradle and downstream of said overtwist roller with respect to the direction of movement of the cord through the apparatus, for taking up said cord; and a lay plate fixed with respect to an inner race of a bearing means having the outer face fixed with respect to said machine base, said lay plate having therein a plurality of holes through which respective of said wire strands pass, such that said lay plate is rotatable within said bearing means by passage of said wire strands through said holes, said holes being equally spaced around a circumference passing through the centers of said holes.

6. An apparatus as claimed in claim 5, wherein said lay plate is positioned immediately downstream of said overtwist roller, with respect to said direction of movement.

7. An apparatus as claimed in claim 5, wherein said lay plate is positioned upstream of said overtwist roller, with respect to said direction of movement.

8. An apparatus as claimed in claim 1 or claim 5, further comprising a ring fixed between said lay plate and said inner race, said ring having extending therefrom a disc, and electromagnet means, fixed with respect to said machine base adjacent said disc, for adjusting the rolling friction of said lay plate with respect to said bearing means.

9. An apparatus as claimed in claim 1 or claim 5, wherein said bearing means comprises an inner bearing having inner and outer races, and an outer bearing having an inner race secured to said outer race of said inner bearing and an outer race secured to said machine base, and further comprising a ring fixed between said lay plate and said inner race of said inner bearing, said ring having extending therefrom a disc, and electromagnet means, fixed with respect to said machine base, adjacent said disc, for adjusting the rolling friction of said lay plate with respect to said bearing means.

* * * * *